US011344903B2

(12) United States Patent
Ikushima

(10) Patent No.: US 11,344,903 B2
(45) Date of Patent: May 31, 2022

(54) LIQUID MATERIAL DISCHARGE DEVICE COMPRISING BOOSTER CIRCUIT

(71) Applicant: MUSASHI ENGINEERING, INC., Mitaka (JP)

(72) Inventor: Kazumasa Ikushima, Tokyo (JP)

(73) Assignee: MUSASHI ENGINEERING, INC., Tokyo (JP)

( * ) Notice: Subject to any disclaimer, the term of this patent is extended or adjusted under 35 U.S.C. 154(b) by 954 days.

(21) Appl. No.: 16/078,154

(22) PCT Filed: Feb. 20, 2017

(86) PCT No.: PCT/JP2017/006062
§ 371 (c)(1),
(2) Date: Aug. 21, 2018

(87) PCT Pub. No.: WO2017/145969
PCT Pub. Date: Aug. 31, 2017

(65) Prior Publication Data

US 2021/0187529 A1 Jun. 24, 2021

(30) Foreign Application Priority Data

Feb. 22, 2016 (JP) ..... JP2016-030577

(51) Int. Cl.
*B05B 9/04* (2006.01)

(52) U.S. Cl.
CPC ..... *B05B 9/0413* (2013.01)

(58) Field of Classification Search
CPC . B05B 9/0413; B05C 5/0225; B05C 11/1034; B05C 11/1047; B05C 11/1028;
(Continued)

(56) References Cited

U.S. PATENT DOCUMENTS 3,851,801 A * 12/1974 Roth ..... B05B 9/01 222/146.5
5,022,556 A * 6/1991 Dency ..... B05C 11/10 222/1

(Continued)

FOREIGN PATENT DOCUMENTS

CN 103217990 A 7/2013
CN 103889589 A 6/2014

(Continued)

OTHER PUBLICATIONS

International Search Report dated Apr. 11, 2017, issued in counterpart International Application No. PCT/JP2017/006062. (2 pages).

(Continued)

*Primary Examiner* — Vishal Pancholi
(74) *Attorney, Agent, or Firm* — WHDA, LLP

(57) ABSTRACT

A liquid material discharge device includes: a plunger including a piston formed at a rear end a piston chamber in which the piston is disposed and to which pressurized gas is supplied; a pressure supply device that supplies, to the piston chamber, air pressurized in excess of the urging force of the elastic body, or that purges pressurized air out of the piston chamber, the liquid material discharge device discharging the liquid material from the discharge port by causing the plunger to move forward and applying an inertial force to the liquid material; a booster circuit that communicates the pressure supply device and an air source with each other, and the booster circuit includes a first and a second booster system including a booster valve and a pressure reducing valve, and a merging section in which the first booster system and the second booster system merge together.

14 Claims, 4 Drawing Sheets

(58) Field of Classification Search
CPC ..... F15B 11/028; H05K 3/3484; H05K 2203/0126
USPC ..... 222/401
See application file for complete search history.

(56) References Cited

U.S. PATENT DOCUMENTS

| | | | | |
|---|---|---|---|---|
| 5,747,102 | A * | 5/1998 | Smith | B05C 5/001 427/98.4 |
| 6,267,266 | B1 * | 7/2001 | Smith | B05C 11/1034 222/1 |
| 6,736,900 | B2 * | 5/2004 | Isogai | F04C 11/005 118/315 |
| 7,134,617 | B2 | 11/2006 | Ikushima | |
| 8,695,377 | B2 | 4/2014 | Bachelier et al. | |
| 9,260,234 | B2 | 2/2016 | Ikushima | |
| 9,314,812 | B2 * | 4/2016 | Clark | B05C 11/10 |
| 9,889,463 | B2 | 2/2018 | Ikushima | |
| 9,919,336 | B2 | 3/2018 | Ikushima | |
| 2003/0132243 | A1 * | 7/2003 | Engel | B05C 11/1002 222/61 |
| 2004/0134996 | A1 | 7/2004 | Kazumasa | |
| 2011/0259046 | A1 | 10/2011 | Bachelier et al. | |
| 2014/0252041 | A1 | 9/2014 | Ikushima | |
| 2015/0014362 | A1 | 1/2015 | Ikushima | |
| 2016/0107188 | A1 | 4/2016 | Ikushima | |

FOREIGN PATENT DOCUMENTS

| | | | |
|---|---|---|---|
| JP | 58-77146 | A | 5/1983 |
| JP | 10-305223 | A | 11/1998 |
| JP | 2002-282740 | A | 10/2002 |
| JP | 2010-536004 | A | 11/2010 |
| JP | 2013-81884 | A | 5/2013 |
| WO | 2013/118669 | A1 | 8/2013 |

OTHER PUBLICATIONS

Translation of International Preliminary Report on Patentability issued in counterpart International Application No. PCT/JP2017/006062. (4 pages).
Office Action dated May 8, 2020, issued in counterpart CN Application No. 201780012715.0, with English Translation. (9 pages).

* cited by examiner

LIQUID MATERIAL DISCHARGE DEVICE COMPRISING BOOSTER CIRCUIT

TECHNICAL FIELD

The present invention relates to a liquid material discharge device including a booster circuit, and more particularly to a liquid material discharge device including a booster circuit with a high boosting action and being able to discharge a highly viscous material at a higher shot pitch (i.e., a shorter cycle time).

BACKGROUND ART

Until now, there have been proposed various discharge devices (also called dispensers) in each of which a small amount of liquid material is discharged from a discharge port in the form of a droplet by employing a reciprocating piston. The applicant of this application has also proposed many discharge devices.

For example, Patent Document 1 proposed by the applicant discloses a droplet discharge method of opening a discharge port by moving a plunger rod backward with air pressure, moving the plunger rod forward with an elastic force of a spring or air pressure, and discharging a droplet from the discharge port with the forward movement of the plunger rod.

Patent Document 2 proposed by the applicant discloses a liquid material discharge device including an elastic body to urge a plunger in a backward direction, and moving the plunger forward by giving a propulsion force to a piston with pressurized gas supplied to a pressurization chamber.

Patent Document 3 proposed by the applicant discloses a liquid material discharge device including a plunger coupled to a piston and moving back and forth in a liquid chamber, an elastic body applying an urging force to the plunger, a piston chamber in which the piston is disposed, and a solenoid valve through which pressurized gas is supplied to the piston chamber or the pressurized gas is purged out of the piston chamber, wherein the solenoid valve is constituted by a plurality of solenoid valves connected in parallel to the piston chamber.

CITATION LIST

Patent Documents

Patent Document 1: Japanese Patent Laid-Open Publication No. 2002-282740

Patent Document 2: Japanese Patent Laid-Open Publication No. 2013-081884

Patent Document 3: International Publication Pamphlet No. 2013/118669

SUMMARY OF INVENTION

Technical Problem

Recently, increasing productivity of discharge work has been demanded in production fields. Thus, in the discharge device of discharging the liquid material by reciprocally operating the plunger, it has been demanded to achieve a larger amount of discharge work performed within a certain time, i.e., a higher shot pitch in the discharge device. A discharge frequency in driving the discharge device has to be increased to realize continuous discharge at a high shot pitch. In the existing discharge device, however, consumption of driving air is increased with an increase of the discharge frequency, and hence a problem arises in that restoration of the air pressure is delayed and the operation of the plunger cannot be performed uniformly.

In the case of discharging a highly viscos material, particularly, the pressure of the driving air has to be raised, and the air consumption is further increased. Thus, the problem that the cycle time cannot be reduced is more serious.

Accordingly, an object of the present invention is to provide a liquid material discharge device capable of reducing the cycle time.

Solution to Problem

The present invention provides a liquid material discharge device comprising a liquid chamber that is communicated with a discharge port and is supplied with a liquid material; a plunger including a piston formed at a rear end thereof and having a tip portion that is moved back and forth in the liquid chamber; an elastic member that applies an urging force to the plunger; a piston chamber in which the piston is disposed and to which pressurized gas is supplied; and a pressure supply device that supplies, to the piston chamber, air pressurized in excess of the urging force of the elastic body, or that purges pressurized air out of the piston chamber, the liquid material discharge device discharging the liquid material from the discharge port by causing the plunger to move forward and applying an inertial force to the liquid material, wherein the liquid material discharge device further comprises a booster circuit that communicates the pressure supply device and an air source with each other, and the booster circuit includes a first booster system including a booster valve and a pressure reducing valve, a second booster system including a booster valve and a pressure reducing valve, and a merging section in which the first booster system and the second booster system merge together.

In the above liquid material discharge device, the first booster system may include a first check valve in a flow path connected to the merging section, and the second booster system may include a second check valve in a flow path connected to the merging section. In such a case, preferably, the first booster system includes a storage tank disposed downstream of the booster valve, and the second booster system includes a storage tank disposed downstream of the booster valve. More preferably, the storage tank in the first booster system is constituted by an upstream-side storage tank and a downstream-side storage tank, and the storage tank in the second booster system is constituted by an upstream-side storage tank and a downstream-side storage tank.

In the above liquid material discharge device, the booster circuit may include a branch portion at which the pressurized air supplied from the air source is branched to the first booster system and the second booster system.

In the above liquid material discharge device, the first booster system may be connected to a first air source, and the second booster system may be connected to a second air source.

The above liquid material discharge device may further comprise a pressure adjustment valve that is disposed downstream of the booster circuit to supply the pressurized air under adjusted pressure to the pressure supply device.

In the above liquid material discharge device, the elastic body may urge the piston upward, and the pressure supply device may supply the pressurized air acting to move the piston downward, or the elastic body may urge the piston downward, and the pressure supply device may supply the pressurized air acting to move the piston upward.

In the above liquid material discharge device, the pressure supply device may be constituted by a solenoid valve.

The above liquid material discharge device may further comprise a reservoir in communication with the liquid chamber, a pressure reducing valve for the reservoir through which the pressurized air is supplied under desired pressure to the reservoir, and an opening/closing valve that establishes or cuts off communication between the reservoir and the pressure reducing valve for the reservoir. In such a case, the above liquid material discharge device may comprise a branch portion that communicates the pressure reducing valve for the reservoir and the air source with each other.

The above liquid material discharge device may further comprise a reservoir in communication with the liquid chamber, a pressure reducing valve for the reservoir through which the pressurized air is supplied under desired pressure to the reservoir, and a switching valve having a first position at which the reservoir and the pressure reducing valve for the reservoir are communicated with each other, and a second position at which the reservoir and the outside are communicated with each other. In such a case, the pressure reducing valve for the reservoir may be connected to an air source different from the booster circuit.

The present invention further provides an application apparatus comprising the above liquid material discharge device, a worktable on which an application target object is placed, and a relatively moving device that moves the liquid material discharge device and the application target object relative to each other.

Advantageous Effect of Invention

According to the present invention, the liquid material discharge device can be obtained which includes the booster circuit with a high boosting action, and which enables discharge work to be performed at a high shot pitch.

DESCRIPTION OF EMBODIMENTS

A liquid material discharge device representing an embodiment of the present invention will be described below. In the following, for convenience of explanation, a direction in which a liquid material is discharged is called a "downward" or "forward" direction, and a direction opposite to the discharge direction is called an "upward" or "rearward" direction in some cases.

Example 1

Figure 1:
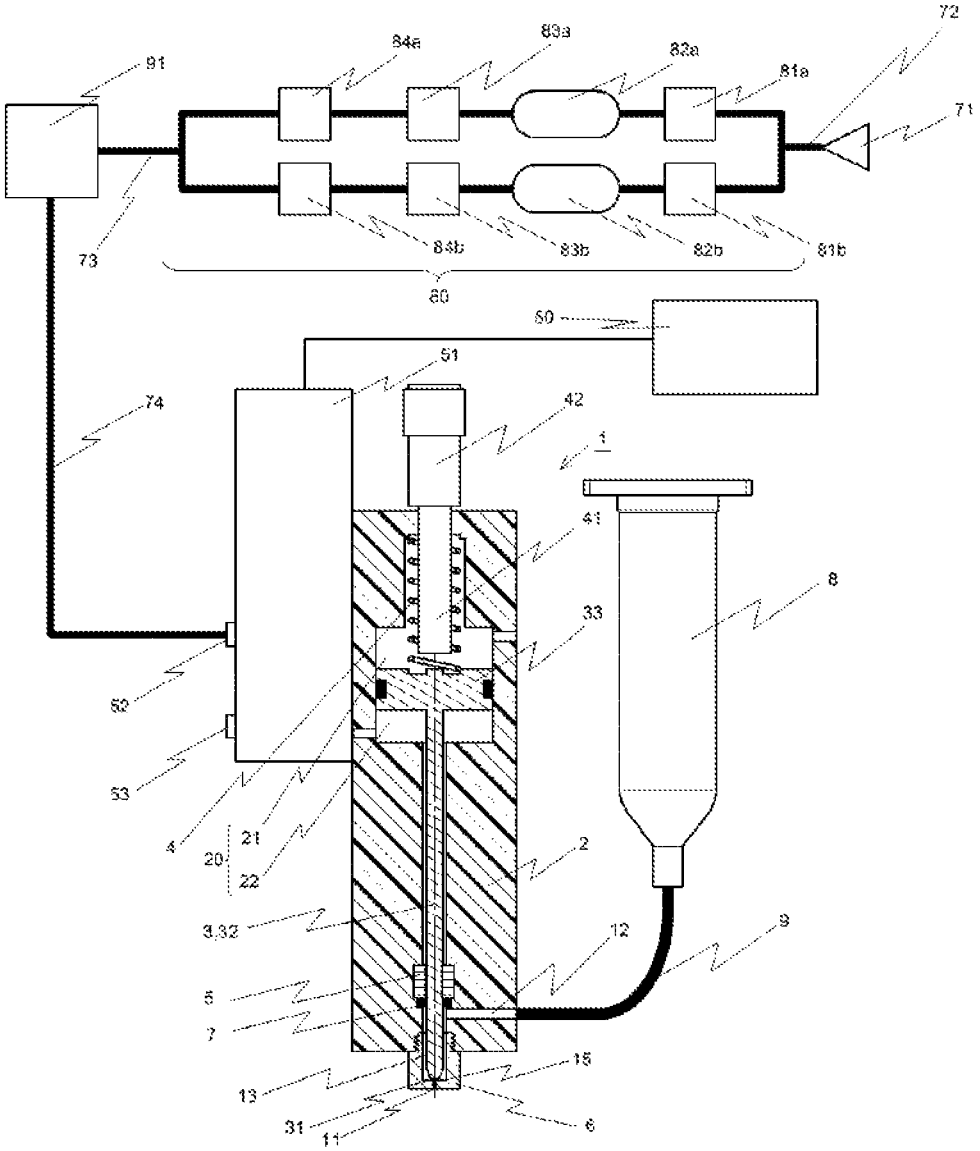
FIG. 1 is a schematic view illustrating a configuration of a liquid material discharge device according to Example 1.

A discharge device 1, illustrated in FIG. 1, according to Example 1 includes a plunger 3 having a tip portion 31 that is moved back and forth in a liquid chamber, an elastic member 4 that urges the plunger in the forward direction, a piston chamber 20 in which a piston 33 formed at a rear end of the plunger 3 is disposed, and a booster circuit 80 boosting pressure of driving air that is supplied to the piston chamber 20. The piston 33 receives a propulsion force given as an urging force of the elastic member 4, whereby the plunger 3 is moved forward and the liquid material is discharged.

The driving air before being subjected to pressure regulation is supplied from an air source 71. The air source 71 is constituted using, for example, factory pressure (e.g., 0.4 to 0.7 [MPa]) supplied from a compressor installed in a factory, or gas pressure supplied from a bomb or the like. In many cases, the discharge device 1 is used in a state that the air source 71, which is installed in a production field, and the booster circuit 80 are connected to each other using a detachable connector (not illustrated). It is to be noted that, in this Description, the word "air" is used as the meaning not limited only to air, but as the meaning including another type of gas (e.g., nitrogen gas).

The booster circuit 80 is constituted by a first booster system (81*a* to 84*a*) and a second booster system (81*b* to 84*b*), which are disposed in parallel. The driving air from the air source 71 is supplied to the first booster system (81*a* to 84*a*) and the second booster system (81*b* to 84*b*) via a connection pipe 72 having a branched portion. Flow path lengths from the air source 71 to the first booster system (81*a* to 84*a*) and the second booster system (81*b* to 84*b*) are the same (although those lengths are not always required to be the same). The first booster system (81*a* to 84*a*) and the second booster system (81*b* to 84*b*) are constituted by devices of the same type and pipes having the same length.

Downstream ends of the first booster system (81*a* to 84*a*) and the second booster system (81*b* to 84*b*) are communicated with a merging pipe 73, and airs from the individual systems are merged together in the merging pipe 73 and then supplied to an air pressure adjustment valve 91.

In Example 1, a flow path length from the air source 71 to the air pressure adjustment valve 91 through the first booster system (81*a* to 84*a*) and a flow path length from the air source 71 to the air pressure adjustment valve 91 through the second booster system (81*b* to 84*b*) are substantially the same. While, in FIG. 1, the driving air from one air source 71 is branched into two systems by the connection pipe 72, two air sources may be disposed, and those air sources may be connected to the booster systems in a one-to-one relation.

Booster valves 81*a* and 81*b* boost pressures of the airs (namely pressurize the airs) supplied from the air source 71. In Example 1, since the airs are pressurized by the two booster valves 81*a* and 81*b*, the boosting action can be realized at a level, e.g., twice that in the case of using one booster valve. The boosted (pressurized) airs are regulated to the desired pressure by pressure reducing valves 83*a* and 83*b* disposed on the downstream side. Because, after boosting the pressures of the airs supplied from the air source 71, the air pressures are regulated by the pressure reducing valves 83*a* and 83*b*, the airs can be supplied in a condition accurately held at the desired pressure value (e.g., 1.0 MPa) higher than that in the air source 71. The booster valves 81*a* and 81*b* are particularly effective when pressure at such a high level as not produced by a compressor is required. Although two booster systems are disposed in Example 1, three to five or four to six booster systems may be disposed in another example. Similarly, the air sources may be disposed in number (e.g., three to five or four to six) in a one-to-one relation to the booster systems.

Storage tanks 82*a* and 82*b* are disposed respectively between the booster valves 81*a*, 81*b* and the pressure reducing valves 83*a*, 83*b*. The storage tanks 82*a* and 82*b* are buffer tanks for holding the airs pressurized by the booster valves 81*a* and 81*b*. Thus, the storage tanks 82*a* and 82*b* are able to prevent shortage of the supplied air when the driving air is continuously consumed, and to stably supply the air under constant pressure. Preferably, in order to stock the air under high pressure, the booster valves 81*a* and 81*b* are operated during a period in which the discharge work is not performed.

Check valves 84*a* and 84*b* are disposed near the downstream ends of the individual systems. Each of the check valves 84*a* and 84*b* serves to prevent the air from flowing backward from one system to the other system. If the check valves 84*a* and 84*b* are not disposed, an unwanted air flow would generate between the systems when there occurs a difference between secondary pressures of the pressure reducing valves 83*a* and 83*b* disposed in the individual systems. The provision of the check valves 84*a* and 84*b* ensures that a flow direction in a region from the air source 71 to the merging pipe 73 is kept positive. A downstream end of the merging pipe 73 is connected to the air pressure adjustment valve 91.

The air pressure adjustment valve 91 is constituted by a pressure reducing valve, for example, and is communicated with an air supply port 52 of a pressure supply device 51 via a supply pipe 74. The air pressure adjustment valve 91 adjusts the pressure of the air supplied from the merging valve 73 to air pressure optimum for driving the piston 33. In other words, the air supplied from the air source 71 is adjusted to the air pressure optimum for driving the piston 33 after passing through the booster circuit 80 and the air pressure adjustment valve 91. The pressure of the air supplied from the air pressure adjustment valve 91 to the pressure supply device 51 is usually higher than the supply pressure of the air source 71 at all times, but air under pressure lower than the supply pressure of the air source 71 may also be supplied.

The pressure supply device 51 is a switching valve capable of taking a first position at which a forward piston chamber 22 and an air supply port 52 are communicated with each other, and a second position at which the forward piston chamber 22 and an air purge port 53 are communicated with each other. When the pressure supply device 51 takes the first position, the air is supplied to the forward piston chamber 22 from the air supply port 52, whereupon the piston 33 (i.e., the plunger 3) is moved backward. When the pressure supply device 51 takes the second position, the air in the forward piston chamber 22 is purged out to the outside through the air purge port 53, whereupon the piston 33 (i.e., the plunger 3) is moved forward by the action of the elastic member 4. A pipe may be coupled to the air purge port 53 such that the air is purged out to any desired position.

The pressure supply device 51 is constituted by a solenoid valve or a three-way valve, for example. The pressure supply device 51 is electrically connected to a control device 50 and is switched over between the first position and the second position in accordance with a position switching signal that is output from the control device 50 at a predetermined discharge frequency.

The piston chamber 20 is air-tightly divided by the piston 33 equipped with an annular sealing member such that an upper space above the piston 33 serves as a rearward piston chamber 21 and an lower space under the piston 33 serves as the forward piston chamber 22.

A rearward stopper 41 is disposed in the rearward piston chamber 21 and is positioned in contact with a rear end (rearward contact portion) of the piston 33 to specify a most contracted position of the piston 33. The rear end of the piston 33 is not limited to the illustrated shape, and it may include, for example, a projection opposing to the rearward stopper 41.

The rearward stopper 41 is coupled to a micrometer 42 that is disposed in a state inserted through a rear end portion of a main body 2, and both the rearward stopper 41 and the micrometer 42 function as a stroke adjustment mechanism. In other words, a plunger stroke can be adjusted by turning the micrometer 42 and moving a tip end of the rearward stopper 41 in a vertical direction.

The elastic member 4 is disposed in the rearward piston chamber 21. A rod portion 32 of the plunger is inserted through the elastic member 4. The elastic member 4 is in the form of a compressed coil spring, and it has one end held in contact with or fixed to a ceiling portion of the rearward piston chamber 21 and the other end held in contact with or fixed to the piston 33. The piston 33 is moved forward with elastic energy of the elastic member 4, whereby the compressed air in the rearward piston chamber 21 is purged out in a short time. Hence the cycle time can be reduced.

The rod portion 32 of the plunger is inserted through a guide 5 and is guided not to sway in a right-left direction. An annular seal 7 is disposed under the guide 5 to prevent intrusion of the liquid material. A tip end of the rod portion 32 constitutes a tip portion 31, and it is moved back and forth inside a liquid chamber 13 having a greater width (larger diameter) than the tip portion 31. The liquid material is discharged in a droplet state from a discharge port 11 with the tip portion 31 applying an inertial force to the liquid material present in a forward direction of the tip portion 31. The tip portion 31 of the plunger may have any desired shape without being limited to the illustrated shape like a bomb shell. It is disclosed herein that the tip portion 31 may have, for example, a planar shape, a spherical shape, or a shape having a projected end.

The liquid chamber 13 is communicated with a liquid feed path 12, and the liquid material is supplied to the liquid chamber 13 from a reservoir 8 through a liquid feed pipe 9. The reservoir 8 in Example 1 is constituted by a syringe in which the liquid material stored there is not pressurized, and the liquid material is supplied to the liquid chamber 13 due to its own weight. The liquid feed pipe 9 may be formed of any suitable member insofar as fluid connection can be established between the main body and the reservoir, and it is not always required to be a circular pipe. In another example, the liquid feed pipe 9 may be formed by boring a flow path through a block-like member.

A nozzle member 10 including the liquid chamber 13 formed therein is screwed into a lower end of the main body 2. The discharge port 11 opening downward is formed at the center of a bottom surface of the nozzle member 10. The forward movement of the plunger 3 is stopped as the tip portion 31 of the forward-moving plunger seating against a bottom surface of the liquid chamber 13 (i.e., a valve seat). The technical concept of the present invention can be further applied to another type of discharge device in which, unlike Example 1, the tip portion 31 of the plunger is not seated against the bottom surface of the liquid chamber 13 when the liquid material is discharged.

The present invention can be applied to even the case of discharging a very small amount of liquid having high viscosity, such as a creamy solder, which is not suitable for being discharged with an ink jet technique. Here, the liquid having high viscosity implies, for example, a liquid having viscosity of 1,000 to 500,000 mPa·s, particularly a liquid having viscosity of 10,000 mPa·s to 500,000 mPa·s or a liquid having viscosity of 10,000 mPa·s to 100,000 mPa·s.

Furthermore, the expression "discharging a very small amount of liquid" implies the discharge of, for example, a droplet having a diameter of several ten to several hundred μm at a landing point, or a droplet having a volume of not more than 1 nl (preferably 0.1 to 0.5 nl or less). In the present invention, a droplet can be formed even when the discharge port has a diameter of not more than several ten μm (preferably not more than 30 μm).

The liquid material discharge device 1 is mounted to an application head of an application apparatus, and is used in work of applying the liquid material onto a workpiece while the application head (i.e., the liquid material discharge device 1) and a worktable 103 are relatively moved by an XYZ-axis driver. The XYZ driver is constituted as a known combination of XYZ-axis servomotors and ball screws, for example, and is able to move the discharge port of the liquid material discharge device 1 at any desired position on the workpiece at any desired speed.

With the above discharge device 1 according to Example 1, shortage of the air pressure does not occur even when the continuous discharge is performed at a high shot pitch of 300 shots/sec, for example, using the liquid having high viscosity.

Example 2

A liquid material discharge device 1 according to Example 2 is mainly different from that according to Example 1 in including a branch circuit for applying pressure to the reservoir 8. In the following, different points between both Examples are mainly described, and description of the same points is omitted.

Figure 2:
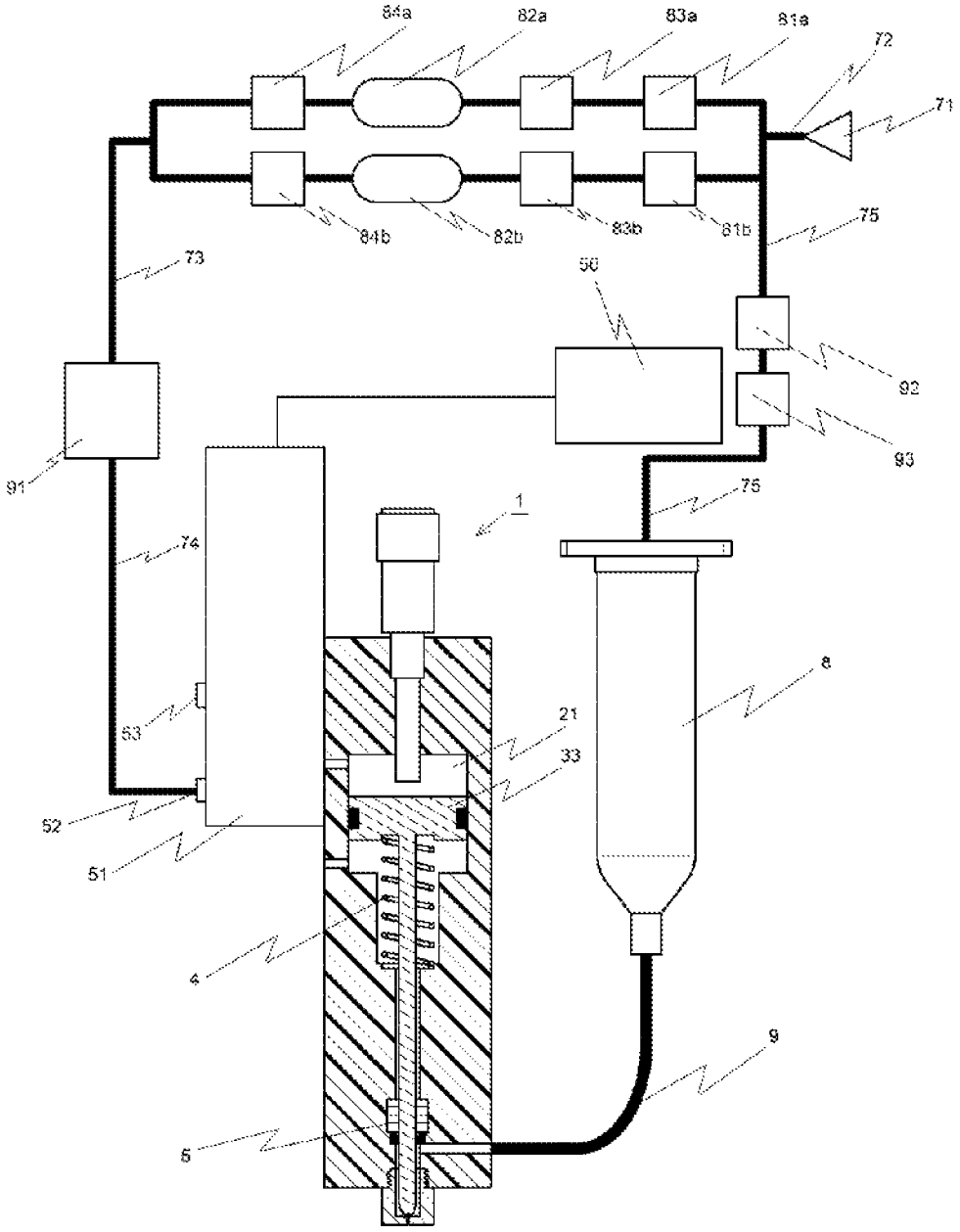
FIG. 2 is a schematic view illustrating a configuration of a liquid material discharge device according to Example 2.

The discharge device 1 according to Example 2, illustrated in FIG. 2, includes a branch pipe 75 branched from the connection pipe 72. In other words, the connection pipe 72 in Example 2 is branched into three branches. The branch pipe 75 is communicated with the reservoir 8, and a pressure reducing valve 92 and an opening/closing valve 93 are disposed midway the branch pipe 75.

The pressure reducing valve 92 decompresses the pressurized air, supplied from the air source 71, to the desired pressure for supply to the reservoir 8. Since the liquid material in the reservoir 8 is pressurized, even a highly viscous material can also be fed to the liquid chamber 13. The opening/closing valve 93 is held in an open state during the discharge work, and it is shifted to a closed state when the reservoir 8 is replaced. The reservoir 8 is constituted by a cover-equipped syringe in which the liquid material stored there is pressurized. When the syringe is replaced after the liquid material has been fully consumed, the replacement of the syringe can be quickly performed by dropping pressure at the pressure reducing valve 92 to the atmospheric pressure, and by closing the opening/closing valve 93. If the opening/closing valve 93 is not disposed, the syringe has to be replaced in an air blowing state. Thus, the air is wastefully consumed, and work of replacing the syringe cannot be safely performed.

In the discharge device 1 according to Example 2, when the pressure supply device 51 takes the first position, the air is supplied to the rearward piston chamber 21 from the air supply port 52, whereupon the piston 33 (i.e., the plunger 3) is moved forward. When the pressure supply device 51 takes the second position, the air in the rearward piston chamber 21 is purged out to the outside through the air purge port 53, whereupon the piston 33 (i.e., the plunger 3) is moved backward by the action of an elastic member 4. The other configuration is similar to that in Example 1.

With the liquid material discharge device 1 according to Example 2, the air supplied from the air source 71 is branched to be able to pressurize the liquid material in the liquid reservoir 8 through the pressure reducing valve 92, and this configuration is effective particularly in the work of discharging the liquid material having high viscosity.

Example 3

A liquid material discharge device 1 according to Example 3 is mainly different from that according to Example 2 in arranging the elastic member 4 above the piston 33. In the following, different points between both Examples are mainly described, and description of the same points is omitted.

Figure 3:
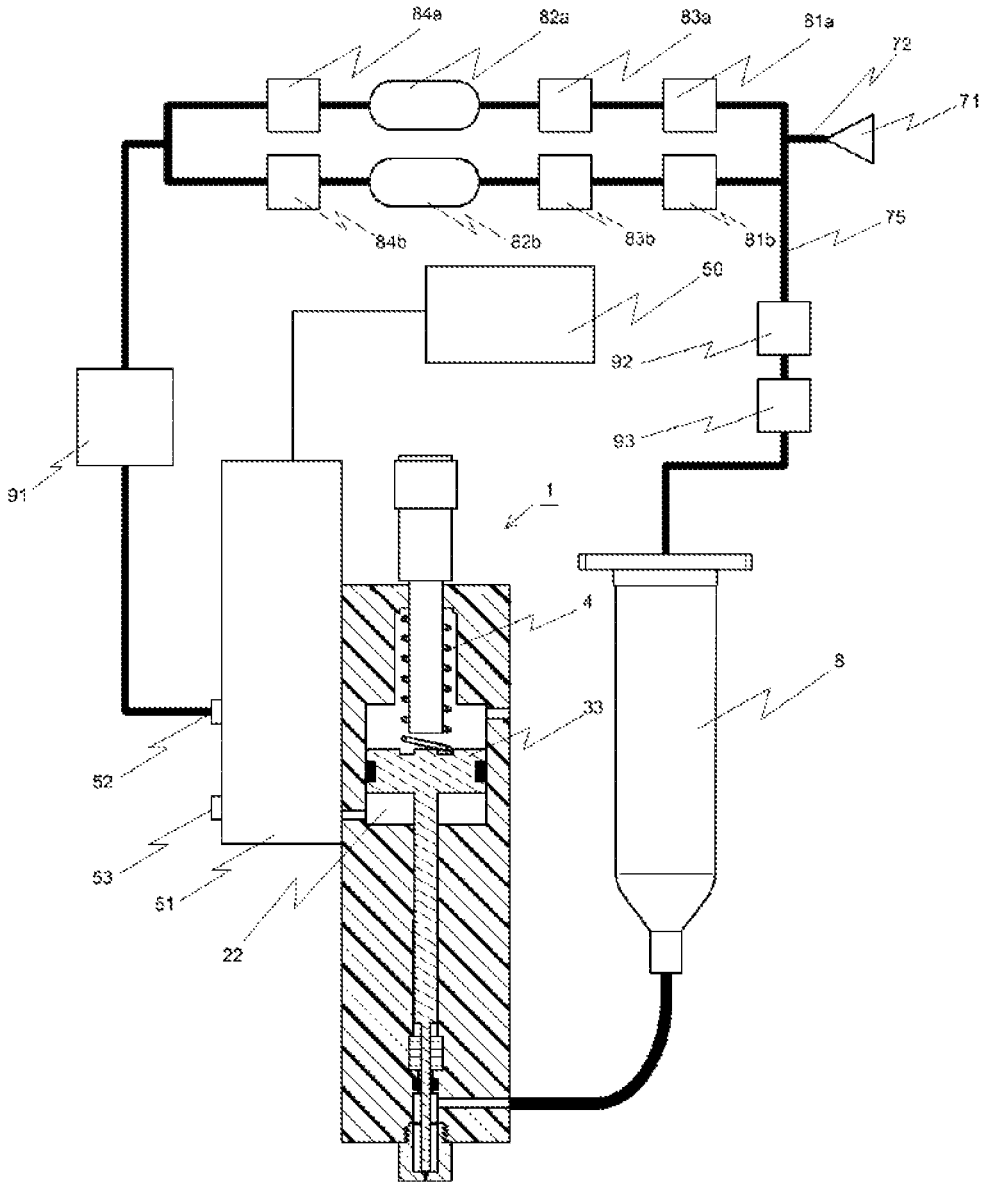
FIG. 3 is a schematic view illustrating a configuration of a liquid material discharge device according to Example 3.

In the discharge device 1 according to Example 3 illustrated in FIG. 3, when the pressure supply device 51 takes the first position, the air is supplied to the forward piston chamber 22 from the air supply port 52, whereupon the piston 33 (i.e., the plunger 3) is moved backward. When the pressure supply device 51 takes the second position, the air in the forward piston chamber 22 is purged out to the outside through the air purge port 53, whereupon the piston 33 (i.e., the plunger 3) is moved forward by the action of the elastic member 4.

Furthermore, in the discharge device 1 according to Example 3, the rod portion 32 of the plunger is made up of a larger diameter portion and a smaller diameter portion, and a tip end of the smaller diameter portion inserted through the guide 5 constitutes the tip portion 31. The other configuration is similar to that in Example 2.

The liquid material discharge device 1 according to Example 3 is also effective particularly in the work of discharging the liquid material having high viscosity, as in Example 2, because the discharge device is constituted to be able to pressurize the liquid material in the liquid reservoir 8.

Example 4

A liquid material discharge device 1 according to Example 4 is mainly different from that according to Example 2 in including an air source for pressurization of the reservoir 8, and including two storage tanks (82 and 85) disposed in each of the systems in the booster circuit 80. In the following, different points between both Examples are mainly described, and description of the same points is omitted.

Figure 4:
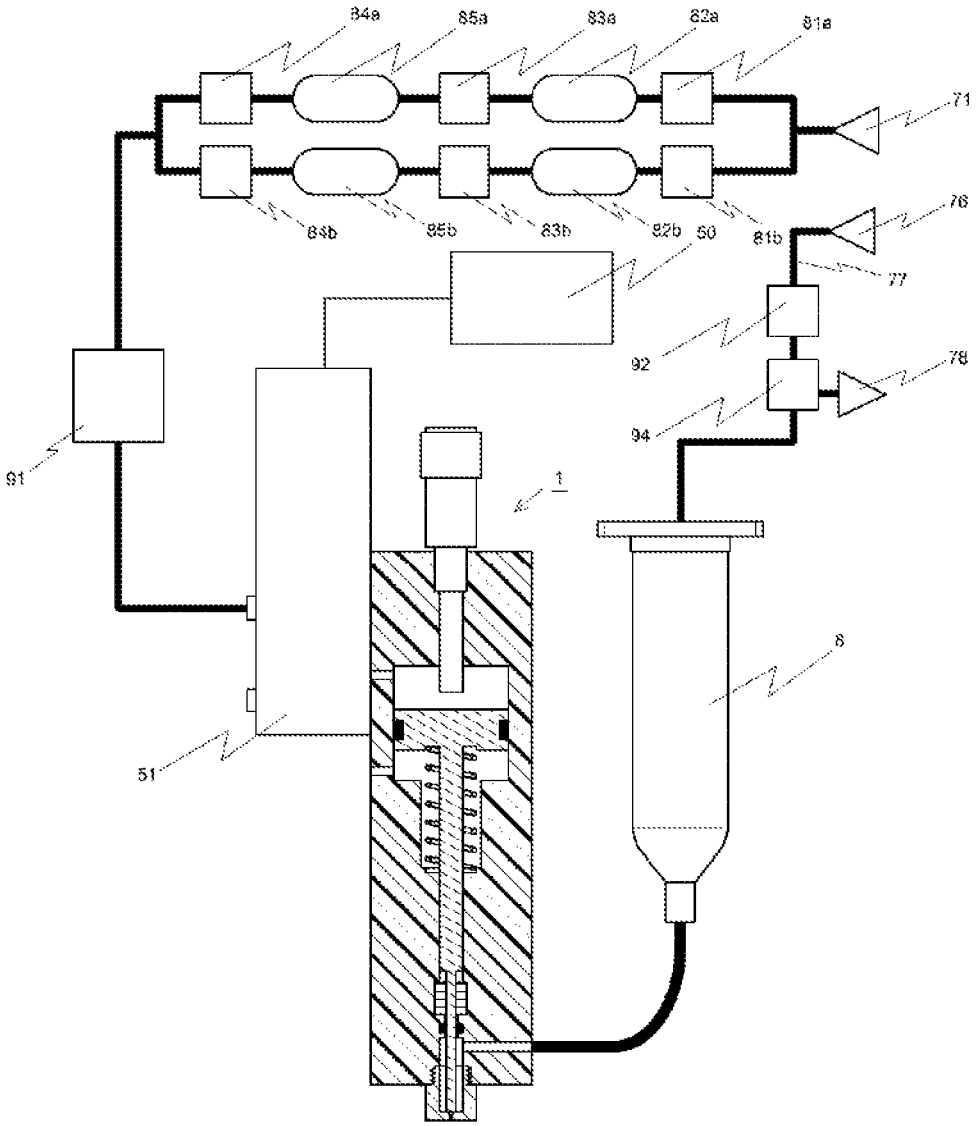
FIG. 4 is a schematic view illustrating a configuration of a liquid material discharge device according to Example 4.

The discharge device 1 according to Example 4, illustrated in FIG. 4, includes an air source 76 for supplying pressurized air to the reservoir 8. The air source 76 is disposed separately from the air source 71 for driving the plunger. It is disclosed herein, by way of example, that the air source 71 is constituted using ordinary factory pressure as an air source, and that the air source 76 is constituted by an air source supplying an inert gas, such as a nitrogen gas. By separating the air source 76 from the air source 71, the type of gas supplied from the air source 76 can be changed depending on the type of the liquid material stored in the reservoir 8.

The air source 76 is communicated with the reservoir 8 through a pipe 77, and a pressure reducing valve 92 and a switching valve 94 are disposed midway the pipe 77. The pressure reducing valve 92 is similar to that used in Examples 2 and 3. Thus, the pressure reducing valve 92 decompresses the pressurized air to the desired pressure and supplies the air under the desired pressure to the reservoir 8.

The switching valve 94 has a first position at which the reservoir 8 is communicated with the pressure reducing valve 92, and a second position at which the reservoir 8 is communicated with a purge port 78. The switching valve 94 is held at the first position during the discharge work, and it is shifted to the second position when the reservoir 8 is replaced. By shifting the switching valve 94 to the second position, the replacement of the reservoir can be performed in a state after safely purging out the gas in the reservoir 8.

The liquid material discharge device 1 according to Example 4 is effective particularly in the work of discharging liquid materials of which properties are changed upon reacting with air, etc., because the liquid material in the liquid reservoir 8 is pressurized with the air supplied from the air source 76 separate from the air source 71.

INDUSTRIAL APPLICABILITY

The present invention can be utilized in all kinds of work in which liquid materials are discharged. Thus, the present invention can be applied to, for example, not only a seal application device and a liquid-crystal dripping device in a liquid-crystal panel manufacturing process, but also a device for applying a solder paste, a device for applying a silver paste, and a device for applying an underfill to printed boards.

The present invention can be applied to any of both types of discharge devices, i.e., the type in which the liquid material is discharged in a flying state from a nozzle by causing the plunger (valve member) to strike against the valve seat (i.e., an inner wall of the liquid chamber), and the type in which the plunger is moved at a high speed and is abruptly stopped to give an inertial force to the liquid material without striking the plunger against the valve seat, thereby causing the liquid material to be discharged in a flying state.

LIST OF REFERENCE SIGNS

1: discharge device, 2: main body, 3: plunger, 4: elastic member, 5: guide, 6: nozzle member, 7: seal, 8: reservoir (syringe), 9: liquid feed tube, 11: discharge port, 12: liquid material supply path, 13: liquid chamber, 15: valve seat, 20: piston chamber, 21: rearward piston chamber, 22: forward piston chamber, 31: tip portion (of plunger), 32: rod portion, 33: piston, 41: rearward stopper, 42: micrometer, 50: control device, 51: pressure supply device, 52: air supply port, 53: air purge port, 71: air source, 72: connection pipe, 73: merging pipe, 74: supply pipe, 75: branch pipe, 76: air source (for pressurization of reservoir), 77: pipe, 78: purge port, 80: booster circuit, 81: booster valve, 82: storage tank, 83: pressure reducing valve, 84: check valve, 91: air pressure adjustment valve (pressure reducing valve), 92: pressure reducing valve (for pressurization of reservoir), 93: opening/closing valve, 94: switching valve

The invention claimed is:

1. A liquid material discharge device comprising:

a liquid chamber that is communicated with a discharge port and is supplied with a liquid material;

a plunger including a piston formed as part thereof and having a tip portion that is moved back and forth in the liquid chamber;

an elastic member that applies an urging force to the plunger;

a piston chamber in which the piston is disposed and to which pressurized gas is supplied; and a pressure supply device that supplies, to the piston chamber, air pressurized in excess of the urging force of the elastic member, or that purges pressurized air out of the piston chamber, the liquid material discharge device discharging the liquid material from the discharge port by causing the plunger to move forward and applying an inertial force to the liquid material, wherein the liquid material discharge device further comprises a booster circuit that communicates the pressure supply device and an air source with each other, the booster circuit includes a first booster system including a booster valve and a pressure reducing valve positioned downstream of the booster valve, a second booster system including a booster valve and a pressure reducing valve positioned downstream of the booster valve, and a merging section in which the first booster system and the second booster system merge together, and a pressure adjustment valve is disposed between the merging section and the pressure supply device.

2. The liquid material discharge device according to claim 1, wherein the first booster system includes a first check valve in a flow path connected to the merging section, and the second booster system includes a second check valve in a flow path connected to the merging section.

3. The liquid material discharge device according to claim 2, wherein the first booster system includes a storage tank disposed downstream of the booster valve, and the second booster system includes a storage tank disposed downstream of the booster valve.

4. The liquid material discharge device according to claim 3, wherein the storage tank in the first booster system is constituted by an upstream-side storage tank and a downstream-side storage tank, and the storage tank in the second booster system is constituted by an upstream-side storage tank and a downstream-side storage tank.

5. The liquid material discharge device according to claim 1, wherein the booster circuit includes a branch portion at which the pressurized air supplied from the air source is branched to the first booster system and the second booster system.

6. The liquid material discharge device according to claim 1, wherein the first booster system is connected to a first air source, and the second booster system is connected to a second air source.

7. The liquid material discharge device according to claim 1, wherein the pressure adjustment valve supplies, to the pressure supply device, the pressurized air under higher pressure than supply pressure of the air source.

8. The liquid material discharge device according to claim 1, wherein the elastic member urges the piston upward, and the pressure supply device supplies the pressurized air acting to move the piston downward, or wherein the elastic member urges the piston downward, and the pressure supply device supplies the pressurized air acting to move the piston upward.

9. The liquid material discharge device according to claim 1, wherein the pressure supply device is constituted by a solenoid valve.

10. The liquid material discharge device according to claim 1, further comprising a reservoir in communication with the liquid chamber;

a pressure reducing valve for the reservoir through which the pressurized air is supplied under desired pressure to the reservoir; and an opening/closing valve that establishes or cuts off communication between the reservoir and the pressure reducing valve for the reservoir.

11. The liquid material discharge device according to claim 1, further comprising a reservoir in communication with the liquid chamber;

a pressure reducing valve for the reservoir through which the pressurized air is supplied under desired pressure to the reservoir; and a switching valve having a first position at which the reservoir and the pressure reducing valve for the reservoir are communicated with each other, and a second position at which the reservoir and the outside are communicated with each other.

12. The liquid material discharge device according to claim 10, further comprising a branch portion that communicates the pressure reducing valve for the reservoir and the air source with each other.

13. The liquid material discharge device according to claim 10, wherein the pressure reducing valve for the reservoir is connected to an air source different from the booster circuit.

14. An application apparatus comprising the liquid material discharge device according to claim 1, a worktable on which an application target object is placed, and a relatively moving device that moves the liquid material discharge device and the application target object relative to each other.

* * * * *